United States Patent [19]

Dubois et al.

[11] Patent Number: 4,710,766

[45] Date of Patent: Dec. 1, 1987

[54] DEVICE FOR DISPLAYING SYMBOLS BY MEANS OF A LIQUID CRYSTAL MATRIX

[75] Inventors: Marcel Dubois, Paris; Pierre Fagard, Montigny le Bretonneux, both of France

[73] Assignee: Societe Francaise d'Equipements pour la Navigation Aerienne, Velizy Villacoublay, France

[21] Appl. No.: 642,815

[22] Filed: Aug. 21, 1984

[30] Foreign Application Priority Data

Aug. 25, 1983 [FR] France ..... 83 13698

[51] Int. Cl.[4] ..... G09G 3/36

[52] U.S. Cl. ..... 340/784; 340/805

[58] Field of Search ..... 340/784, 802, 756, 753, 340/705, 980, 805

[56] References Cited

U.S. PATENT DOCUMENTS

| | | | |
|---|---|---|---|
| 3,444,319 | 5/1969 | Artzt et al. | 340/756 |
| 3,895,372 | 7/1975 | Kaji et al. | 340/784 |
| 3,918,041 | 11/1975 | Mao | 340/756 |
| 3,938,134 | 2/1976 | Hackstein | 340/754 |
| 3,979,793 | 9/1976 | Moore | 340/784 |
| 4,167,113 | 9/1979 | Mann | 358/250 |
| 4,190,832 | 2/1980 | Mohler | 340/705 |
| 4,250,503 | 2/1981 | Shanks | 340/784 |
| 4,359,729 | 11/1982 | Nonomura | 340/784 |
| 4,365,242 | 12/1982 | Yasuda et al. | 340/784 |
| 4,370,647 | 1/1983 | Brantingham | 340/784 |
| 4,462,027 | 7/1984 | Lloyd | 340/784 |

*Primary Examiner*—Marshall M. Curtis

*Attorney, Agent, or Firm*—Finnegan, Henderson, Farabow, Garrett and Dunner

[57] ABSTRACT

A method and device for displaying symbols by means of a liquid crystal matrix. The device comprises an automation driven by a clock which feeds cyclically to the control circuit of a liquid crystal matrix the bits representative of the elementary images contained in a random access memory. The memory has a capacity greater than k (n+m) bits, k being the multiplexing coefficient and n and m being respectively the number of lines and columns of the liquid crystal matrix. The memory is refreshed by a central computer during the interval of emission of the bits.

9 Claims, 13 Drawing Figures

DEVICE FOR DISPLAYING SYMBOLS BY MEANS OF A LIQUID CRYSTAL MATRIX

BACKGROUND OF THE INVENTION

1. Field of the Invention

The present invention relates to a process and device for displaying symbols by means of a liquid crystal matrix.

It applies more especially, but not exclusively, to the construction of sighting pieces or collimators mounted on vehicles, for example helicopters, in which it is necessary to superimpose visible symbols on the outside environment, for example on the external landscape, in the field of vision of an operator, for example the pilot.

2. Description of the Prior Art

It is generally known that numerous display devices or sighting pieces of this kind are already known using electro mechanical systems or cathode tube systems for generating the symbols.

In the electro mechanical systems, the symbols are formed by means of independent optical masks, either mobile or fixed. Usually, the movements of these symbols are provided by means of mobile assemblies sometimes equipped with mirrors. However, the number of symbols generated by these systems is limited because of the complexity and because of the number of mechanical assemblies required. Furthermore, these systems are relatively space consuming and suffer from a certain fragility.

In cathode tube systems, the screen of the cathode tube on which the symbols are generated is disposed in the object focal plane of an optical system serving for example for projecting these symbols on a semi-reflecting mirror. This solution has the advantage of displaying very complex systems of symbols with high definition. On the other hand, it proves to be costly and space consuming, which considerably limits its field of application. To try and overcome these drawbacks attempts have been made to construct display devices using, in optical systems similar to those used for the cathode tubes, liquid crystal matrices which are much less expensive and less space consuming than cathode ray tubes.

It will be recalled here in this connection that a liquid crystal matrix is formed from two transparent parallel glass plates which sandwich therebetween a liquid crystal. Each of these glass plates supports a network of addressable electrodes forming the lines and the columns of the matrix, which are connected to one or more electronic control circuits.

Furthermore, two light polarizers with parallel axes are disposed on each side of the glass plates. The effect used, well known under the name of "twisted nematic" is the following:

At rest, the liquid crystal is orientated so that the molecules rotate through 90° from one edge to the other of the matrix.

Thus, a light beam applied perpendicularly to the matrix thus formed will first of all be polarized rectilinearly through the first polarizer. The polarized light will then be rotated through 90° as it passes through the liquid crystal edge. The polarized light beam will then reach the second polarizer orientated perpendicularly to its axis of polarization. Thus, at the level of the second polarizer, extinction of the light beam is obtained. This extinction is maintained as long as the electric field between the electrodes forming the lines and the columns of the matrix is less than a predetermined electric field, generated by a threshold voltage, Vth.

By applying a sufficiently high electric voltage Von between a line electrode and a column electrode, the molecules will be aligned, at the level of the line and column intersection, along the electric field produced so that, in this zone, the light will not be deflected and will be orientated parallel to the axis of the second polarizer. The second polarizer will then let pass an elementary light dot or pixel (activation of a pixel).

The de-activation or extinction of the pixel is then obtained when the voltage Voff at the level of the pixel is less than a voltage Vth characteristic of the liquid crystal used.

At the present time, the only known way of generating an image on a liquid crystal matrix without memory effect, consists in effecting activation line by line, in which one line is selected at a time and all the electrodes of the columns are activated. Thus, for a matrix of n lines and m columns the multiplexing rate is n.

In addition, in the liquid crystal matrices used at the present time this multiplexing rate is limited by:

- the frequency of refreshment of the image, which is related to the response time of the crystal, and
- the contrast which reduces when the multiplexing rate increases.

It has been worked out that, for this method of activation, the maximum contrast is obtained by the formula (Plesko's formula)

$$\frac{Von}{Voff} = \sqrt{n}$$

It has been proven in practice that the voltage Von is limited by the supply voltage of the "drivers". This is why, at the present time, the multiplexing rate is limited so that the number of lines is itself limited. Consequently, these liquid crystal matrices do not allow images to be obtained having sufficient definition for numerous applications, more especially for constructing sighting pieces of the type mentioned above.

OBJECTS AND SUMMARY OF THE INVENTION

An object of the invention is therefore to overcome this disadvantage by reducing the multiplexing rate while, however, using a liquid crystal matrix having a high number of lines so as to obtain images with good definition.

To arrive at this result, the process of the invention consists in breaking the image down into a given number of elementary images each bringing into play all the lines and all the columns of the matrix, each of these images being formed by an array of light points, the simultaneous activation of which is compatible, and in successively activating these elementary images during the period for refreshing the image.

In this process it has been shown by calculation that the contrast is maximum for voltages Von and Voff such that:

$$\frac{Von}{Voff} = 3 \text{ (or substantially so)}$$

This ratio is then independent of the multiplexing rate and consequently of the number of lines n and columns m of the liquid crystal matrix.

It should be noted that there remains, however, a limitation due to the multiplexing rate. However, in this case, this limitation is only introduced by the complexity of the image to be displayed and is independent of the number of lines and columns of the liquid crystal matrix.

According to another characteristic of the present invention, the generation of the elementary images takes place in accordance with the following sequence:

During the display of the elementary image of index i, a symbol generator feeds the (n+m) bits corresponding to the next elementary image (i+1) into a memory associated with the control circuits (drivers) of the liquid crystal cell. A transfer signal then causes the transfer of these bits to a Von, Voff voltage generating system.

Preferably, the drivers for the matrix are mounted and adjusted so that the Von and Voff voltages applied to the electrodes forming the lines and the columns of the matrix are in the proportion $$\frac{Von}{Voff} = 3 \text{ (or substantially so)}$$

Moreover, with the complete image being refreshed at a frequency F, preferably greater than the flicker frequency, each of the elementary images will be displayed during a period of $1/K \times F$, K being the multiplexing rate.

The invention also relates to a device for implementing the above defined process, this device comprising at least one automaton driven by a clock which cyclically feeds to a control circuit of the liquid crystal matrix the bits representative of the elementary images contained in a RAM of a capacity greater than k(n+m) bits, k being the multiplexing coefficient and n and m being, respectively, the number of lines and columns in the liquid crystal matrix. The RAM is refreshed by a central computer during the intervals of emission of the bits.

BRIEF DESCRIPTION OF THE DRAWINGS

Several embodiments of the invention will be described hereafter by way of non-limiting examples, with reference to the accompanying drawings in which.

DESCRIPTION OF THE PREFERRED EMBODIMENTS

Figure 1:
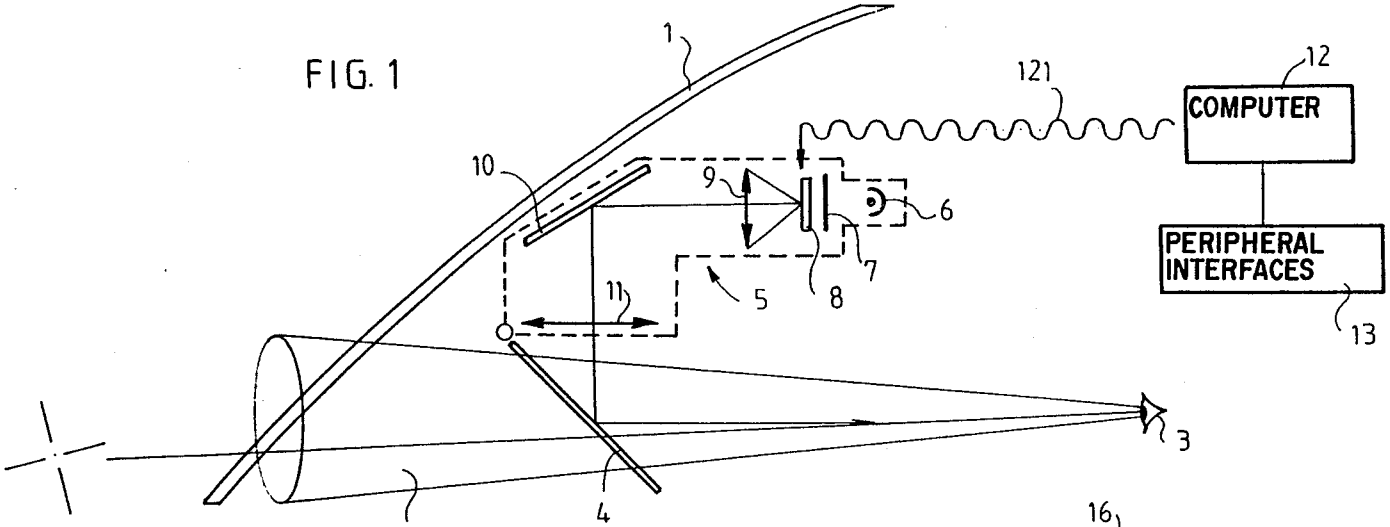
FIG. 1 is a schematic representation of a sighting system equipping an aircraft such as a helicopter.

In the examples shown in FIG. 1, only the canopy 1 of the aircraft has been shown through which the pilot may see the external environment. For greater simplicity, only the field of vision 2 of the pilot has been shown from his eye 3.

In this field of vision 2 is disposed an optical mixer 4 formed, for example, by a partially reflecting mirror forming part of a display device 5 such as a sighting piece and/or even of a head-lifted flight director. This display device 5 is formed of a suitably cooled, focused light source 6 which illuminates through a filter 7, for example an infra red filter and/or a monochromatic filter. A liquid crystal matrix 8 is placed in the object focal plane of an optical system comprising successively a first lens 9, a mirror 10 disposed at an angle of 45° and a second lens 11 with its axis disposed at right angles with respect to the first lens 9. With the optical system, the image of the liquid crystal matrix 8 can be projected onto the partially reflecting mirror 4 so as to be superimposed in the pilot's field of vision 2 of the external environment. The liquid crystal matrix 8 is further connected, through a digital connection 121, to a computer 12 carried by the aircraft, which is connected to different peripheral interfaces proper to the aircraft 13.

Figure 2:
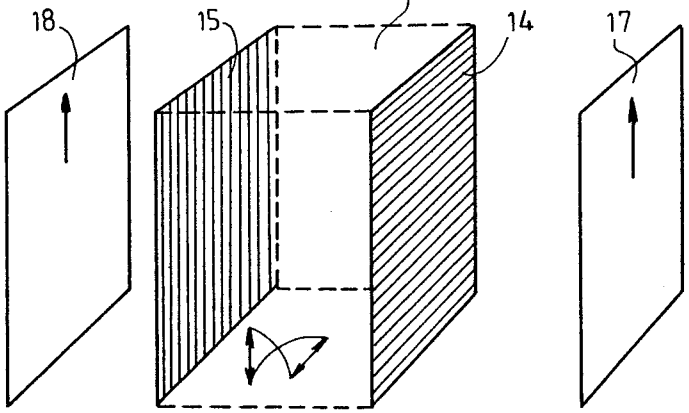
FIG. 2 is an exploded view illustrating the structure of a liquid crystal matrix.

As mentioned above, the liquid crystal matrix 8 is formed from two parallel transparent glass plates 14, 15 between which is disposed a liquid crystal layer 16 (FIG. 2).

Each of these glass plates supports an addressable electrode network forming the lines and the columns of the matrix, which may be connected by flexible connectors to an electronic control circuit.

The matrix further comprises two polarizers 17, 18 with parallel axes disposed on each side of the assembly formed by the two glass plates 14, 15 and the liquid crystal layer 16, one of these polarizers playing the role of an analyzer.

Figure 3:
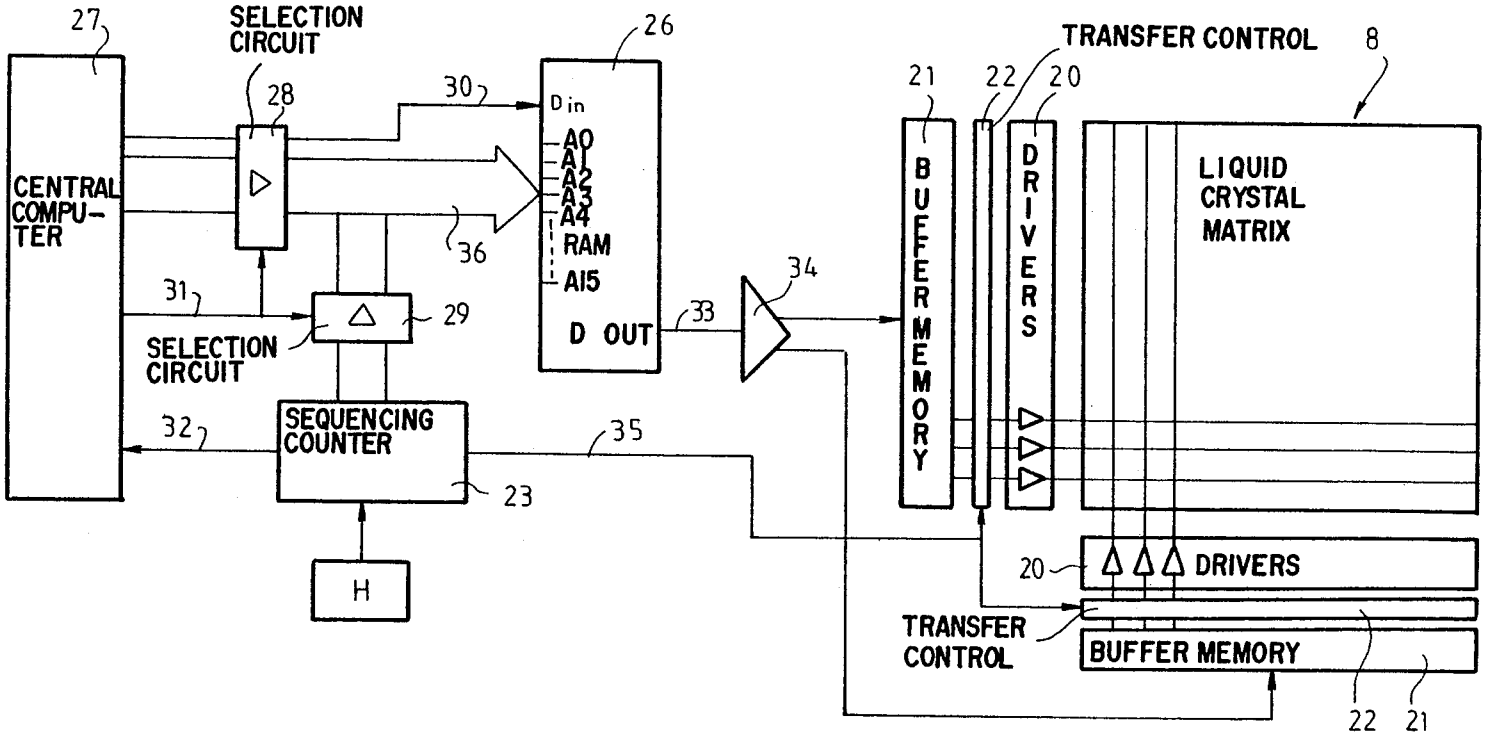
FIG. 3 is a block diagram showing the architecture of a symbol generator coupled to the liquid crystal matrix of FIG. 2.

The operating principle of this matrix which has been described above will not therefore be described again. More precisely, as shown in FIG. 3, each of the line and column electrodes is connected to an amplifier (driver)(block 20) for supplying either a voltage Von for illuminating a pixel, or a voltage Voff for extinguishing the pixel. The amplifiers are adjusted preferably so that the Von/Voff ratio is equal to three (FIG. 3). The control of these amplifiers 20 is provided from a buffer memory 21, through a device 22 controlling transfer of the logic levels (bits) stored in the buffer memory 21 to the electrodes controlling the amplifiers (drivers).

In this device, the symbol generator consists of an automaton driven by a clock H which drives a sequencing counter 23 provided for feeding cyclically the contents of a random access memory RAM 26, to the buffer memories 21 associated with the liquid crystal cell 8. The RAM 26 has a capacity greater than k(n+m) bits, (k being the multiplexing coefficient, n and m being, respectively, the number of lines and columns in the liquid crystal matrix). The RAM 26 is connected by its inputs Ao . . . A15 to an address bus 36 of a computer 27 through a first selection circuit 28. Similarly, the inputs Ao . . . A15 of the RAM are connected to the output of the sequencing counter 23 through a second selection circuit 29.

The connection between the symbol generator and the central computer 27 is further includes a control line 30 $D_{IN}$ (data in) for storing in the RAM 26 information coming from the central computer 27 (and refreshing thereof), a control line 31 driving the selection circuits 28, 29 so as to obtain addressing of the RAM 26 by the central computer 27 or by the sequencing counter 23, and a connection 32 allowing the sequencing counter 23 to send to the central computer 27 a signal indicating the end of the display of an elementary image.

Furthermore, the connection between the symbol generator and the drivers of the liquid crystal matrix comprises, at least a connection 33 connecting the output Dout (data out) of the RAM 26 to the line and column buffer memories 21 of the drivers of the liquid crystal matrix 8, through a line/column selector 34, and a circuit 35 connecting the sequencing counter 23 to the buffer memory/amplifier 20 (drivers) transfer devices 22 of the control circuit of the liquid crystal cell 8. This circuit allows a signal to be transmitted for the transfer.

Memory 26 is refreshed by the central computer 27 through (address bus 36 and, Din line 30 during the emission intervals of the bits, through the selection circuits 28 and 29.

Moreover, the RAM 26, organized by bits, is sequentially emptied by the sequencing counter 23 in the following way, from the most significant bits:

the bits Ao to A3 correspond to the selection of elementary images, bit A4 serves for the line/column selection, bits A5 to A15 supply the order number of the bits.

Figure 4:
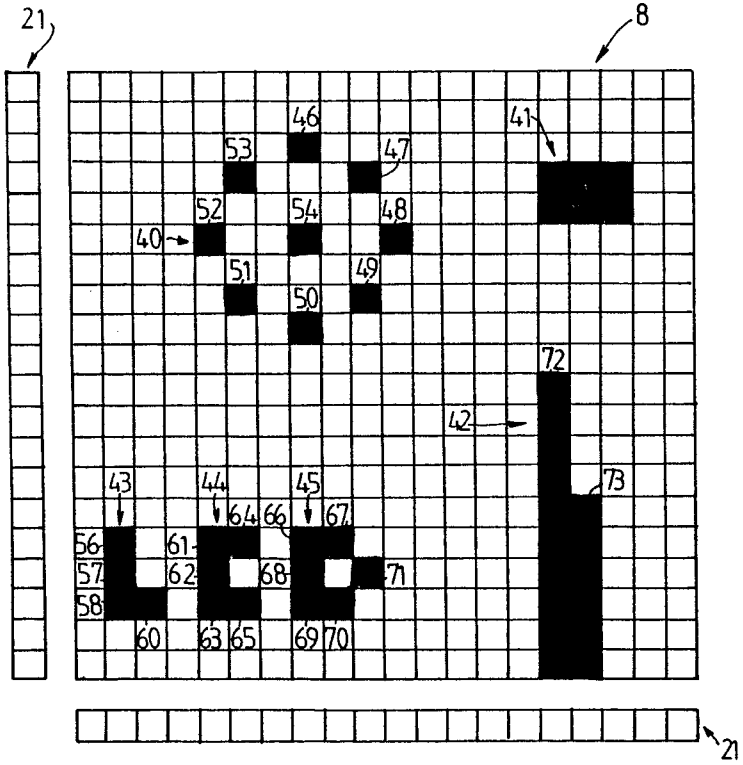
FIG. 4 shows schematically a liquid crystal matrix on which a complete image is generated.

FIG. 4 shows an example of an image to be displayed on a liquid crystal matrix 8 comprising 20 lines and 20 columns. It should be noted that this limited number of lines and columns has been chosen solely for clarity of the drawings. It will be recalled in this connection that the aim of the invention is on the contrary to use matrices having a much higher number of lines and columns, for example more than a 100 lines and more than a 100 columns, so as to be able to obtain images with a relatively high definition.

The image generated on the liquid crystal matrix comprises six symbols 40, 41, 42, 43, 44, and 45 formed by an adequate distribution of illuminated pixels which have, in this example, a square shape.

Symbol 40 is obtained by means of 8 pixels 46 to 53 dispersed over the circumference of a circle whose center is indicated by a pixel 54.

Symbol 41 of rectangular shape uses two rows of three pixels juxtaposed one on the other.

Symbol 43 has the shape of an L and comprises three pixels 56, 57, and 58 juxtaposed on the same column and a pixel 60 on the same line as pixel 58.

Symbol 44 has a C shape comprising three pixels 61, 62, 63 juxtaposed on the same column and two pixels 65, 65 juxtaposed with pixels 61, 63 respectively on the same lines.

Symbol 45 has the shape of a C of the type described above with, in addition to pixels 66 to 70, a pixel 71 disposed on the same line as pixel 68 but offset by a pixel.

Symbol 42 comprises a pattern 72 having ten pixels superimposed in the same column and a pattern 73 having six pixels superimposed in the next column.

As mentioned above, this image is broken down into independent elementary images by taking into account the assemblies of pixels, the simultaneous activations of which are compatible.

Figure 5:
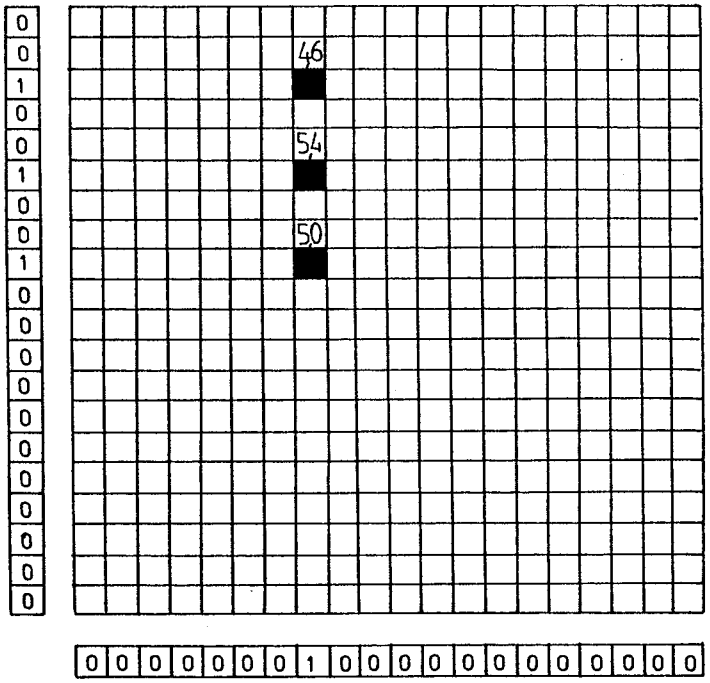
FIGS. 5 to 13 illustrate one method of breaking down the complete image shown in FIG. 4 into elementary images.
Figure 7:
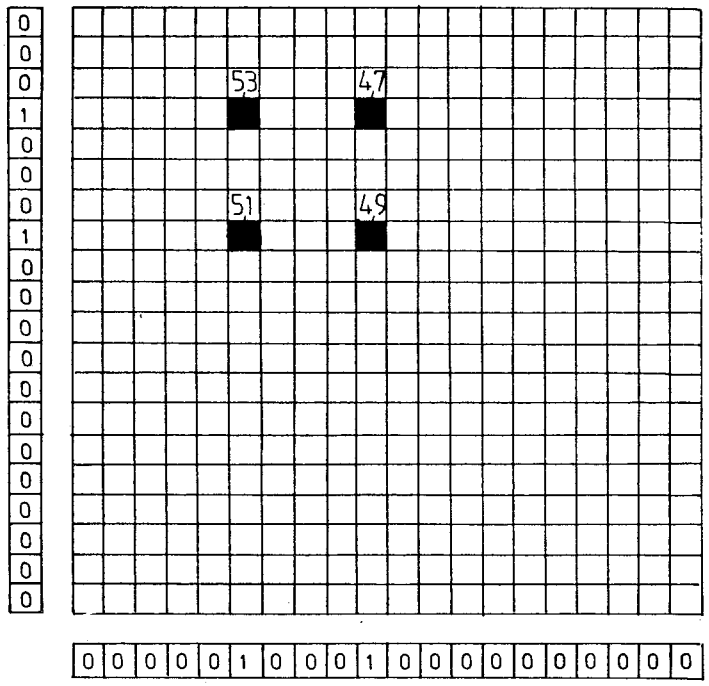
Figure 6:
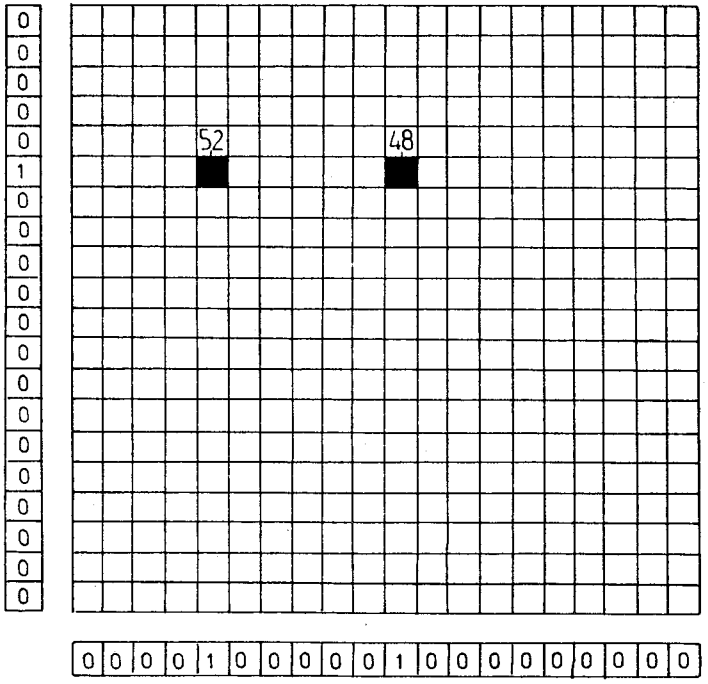
Figure 9:
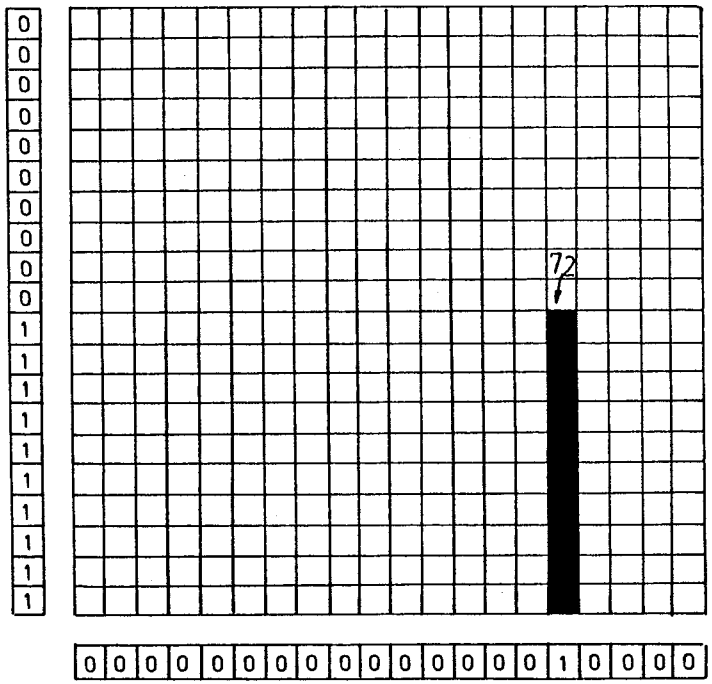
Figure 8:
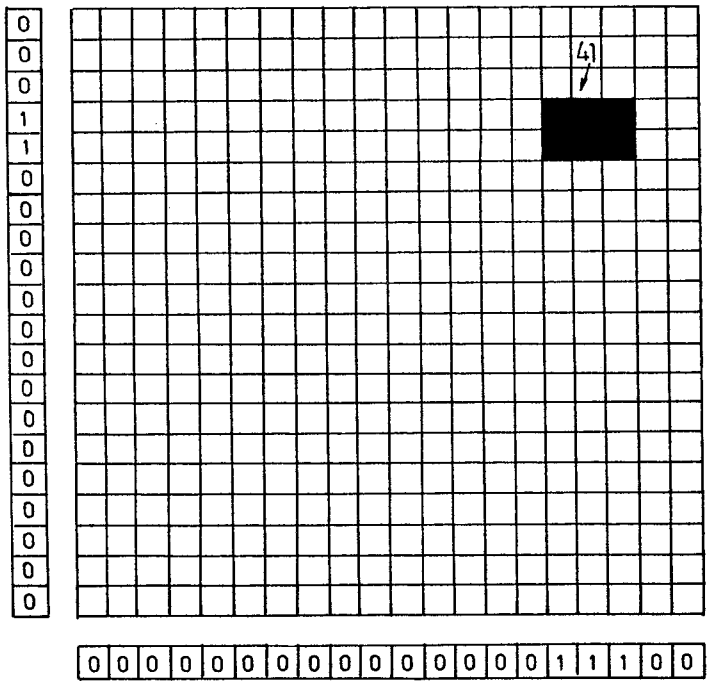
Figure 11:
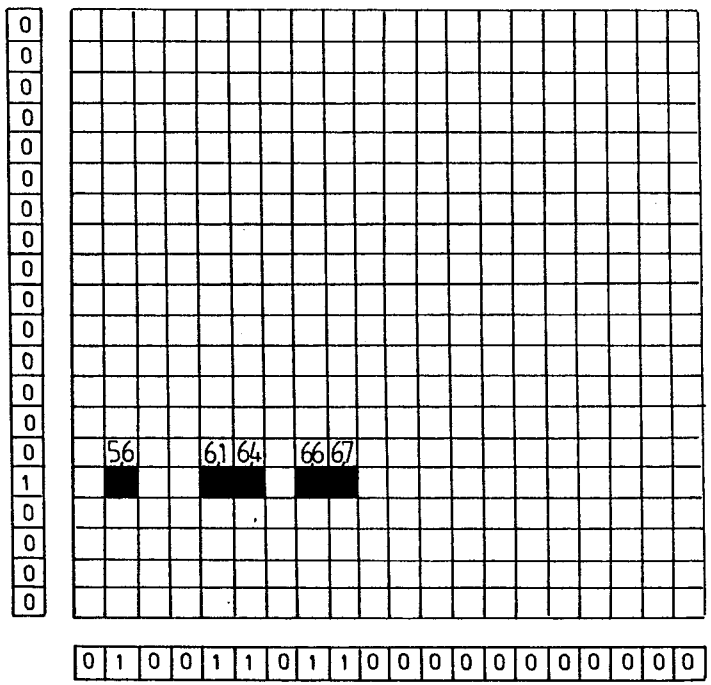
Figure 10:
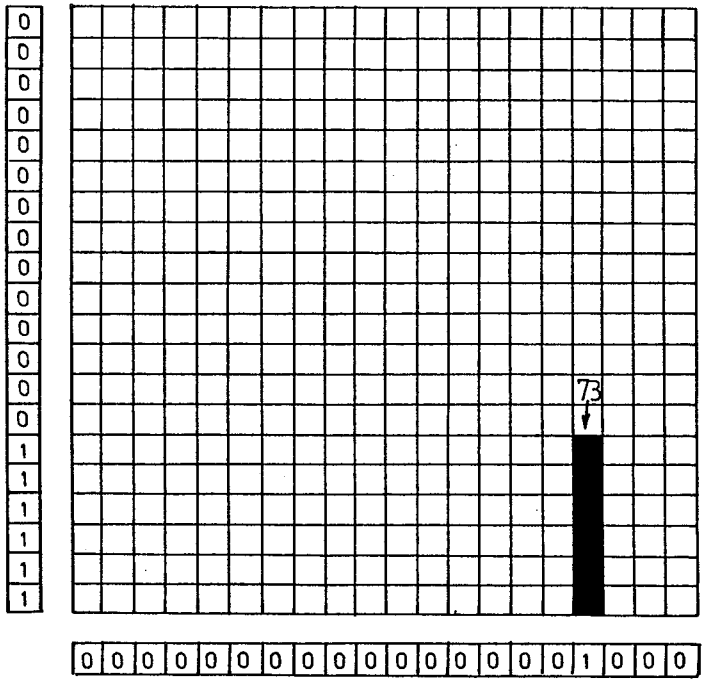
Figure 13:
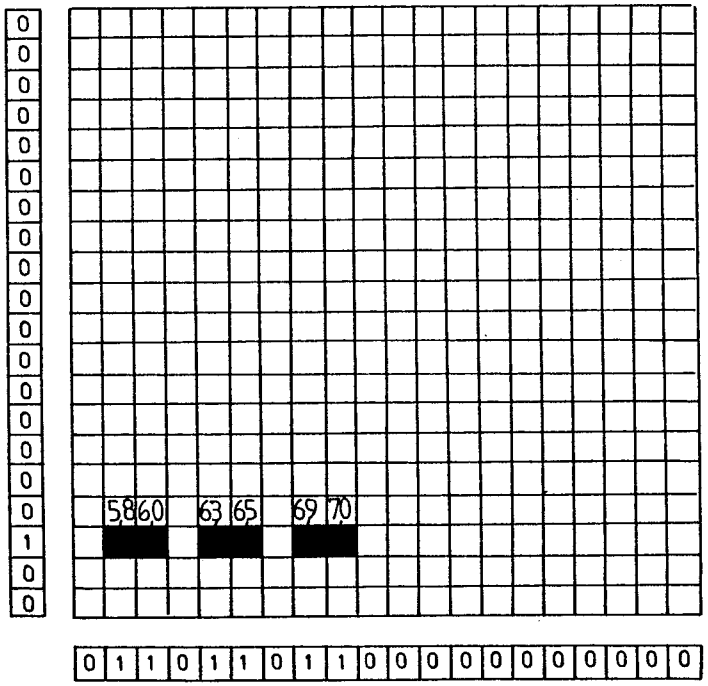
Figure 12:
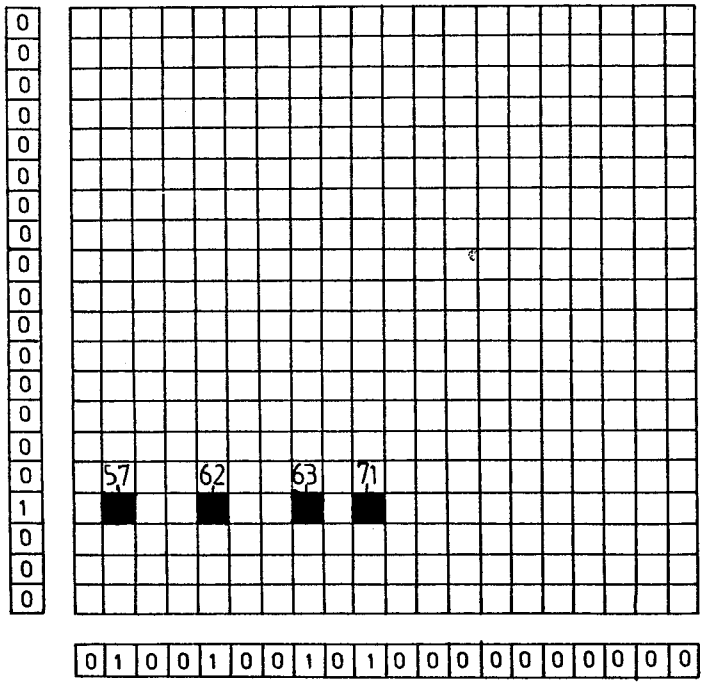

Thus, the image shown in FIG. 4 may be broken down into nine elementary images, namely:

a first elementary image in which the pixels 46, 50, 54 of the first symbol 40, which are disposed in the same column, are illustrated (FIG. 5), a second elementary image in which the pixels 48 and 52 of the symbol 40, which are disposed in the same line, are illuminated (FIG. 6), a third elementary image comprising the pixels 47, 49, 51, 53 situated at the intersection of two lines and two columns (FIG. 7), a fourth elementary image taking up again the symbol 41 as a whole (FIG. 8), fifth and sixth elementary images comprising respectively the patterns 72 and 73 of symbol 42 (FIGS. 9 and 10), sixth, seventh and eighth elementary images each comprising the pixels (56, 61, 64, 66, 67) (57, 62, 63, 71) (58, 60, 63, 65, 69, 70) of the symbols 43, 44, 45, see FIGS. 11, 12 and 13.

It is clear that in the above described example, in the case of line by line activation, the multiplexing rate should be at least 15.

On the other hand, for activation according to the above described elementary images, the multiplexing rate is decreased to 9.

What is claimed is:

1. A device for displaying symbols forming a complete image on a liquid crystal display having a matrix formed from a plurality of lines and a plurality of columns, the device comprising:

a computer having a random access memory for storing and developing in succession a plurality of elementary images derived from the complete image, each of said elementary images being represented by a first assembly of bits equal in number to the number of lines of the matrix, each of said bits in said first assembly having either a first value or a second value and being associated with a different one of the lines of the matrix, and a second assembly of bits equal in number to the number of columns of the matrix, each of said bits in said second assembly having either said first value or said second value and being associated with a different one of the columns of the matrix at least one of said subimages having at least two bits in each said first and second assemblies of bits of each said first value and said second value;

means for refreshing said random access memory during successive periods; and a control circuit connected to said random access memory and to the lines and columns of the matrix for receiving in succession from said random access memory said first assembly of bits and said second assembly of bits corresponding to each of said elementary images and for simultaneously applying to each of the lines of the liquid crystal display either a first voltage level or a second voltage level in accordance with said associated bits in said received first assembly of bits having said first value or said second value, respectively, and to each of the columns of the liquid crystal display either a third voltage level or a fourth voltage level in accordance with said associated bits in said received second assembly of bits having said first value or said second value, respectively, to control the liquid crystal display to display the complete image as a result of the successive display of the elementary images derived therefrom.

2. A device according to claim 1, wherein said ratio of said first voltage level to said second voltage level is approximately 3.

3. A device according to claim 1, wherein the complete imae is refreshed in said random access memory at a frequency F and each of said elementary images is displayed for a period equal to $1/K \times F$ where K is the number of elementary images corresponding to the complete image.

4. A device according to claim 1, wherein said control circuit comprises:

a plurality of row amplifiers, each of said row amplifiers having an output connected to a different one of the lines of the liquid crystal display and an input;

a plurality of column amplifiers, each of said column amplifiers having an output connected to a different one of the columns of the liquid crystal display and an input;

a first buffer memory for successively receiving from said random access memory and for storing said first assembly of bits corresponding to each of said elementary images;

a second buffer memory for successively receiving from said random access memory and for storing said second assembly of bits corresponding to each of said elementary images;

a first transfer circuit for transferring said bits of said received first assembly of bits from said first buffer memory to said inputs of said row amplifiers; and a second transfer circuit for transferring said bits of said received second assembly of bits from said second buffer memory to said inputs of said column amplifiers.

5. A device according to claim 4, further including a first selector circuit connected between said random access memory and said first and second buffer memories for transferring said first bit assemblies and said second bit assemblies to said first buffer memory and said second buffer memory, respectively.

6. A device according to claim 5, wherein said random access memory includes a plurality of address inputs for selecting said elementary images to be transferred to the liquid crystal display and wherein the device further includes an address bus connected between said address inputs of said random access memory and said computer, said address bus for transferring address data from said computer to said random access memory.

7. A device according to claim 6, further including:

a sequence counter having an input and an output;

a clock connected to said input of said sequence counter for driving said sequence counter to generate sequential address signals; and a second selection circuit connecting the output of said sequence counter to said address bus to selectively supply said sequential address signals to said random access memory.

8. A device according to claim 7 wherein said second selection circuit includes a transfer terminal connected to said computer for indicating to said computer when said first and second bit assemblies of an elementary image have been transferred to and displayed on the liquid crystal display.

9. A display device for displaying symbols forming a complete image on a liquid crystal display having a matrix of pixels formed at the intersections of a plurality of display lines and a plurality of display columns of the matrix, the device comprising:

computer means for establishing a plurality of groups of pixel control values associated with each of the complete images, each of said groups of pixel control values adapted to cause the simultaneous energization of a plurality of pixels;

memory means for storing said groups of pixel control values;

sequence control means for controlling said memory means to sequentially output said groups of pixel control values associated with a complete image; and column and row driver means for applying said outputted groups of pixel control values to the display columns and the display lines of the matrix to energize a selected plurality of pixels for each of said groups of pixel control values whereby a plurality of pixels are energized in the same time period for each group of pixel control values to display the complete image as a result of the successive energization of groups of pixels and to reduce the multiplexing factor of the display device.

* * * * *